US011099595B2

(12) United States Patent
Ramorini et al.

(10) Patent No.: US 11,099,595 B2
(45) Date of Patent: Aug. 24, 2021

(54) BANDGAP REFERENCE CIRCUIT, CORRESPONDING DEVICE AND METHOD

(71) Applicant: STMicroelectronics S.r.l., Agrate Brianza (IT)

(72) Inventors: Stefano Ramorini, Arluno (IT); Germano Nicollini, Piacenza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 16/950,267

(22) Filed: Nov. 17, 2020

(65) Prior Publication Data

US 2021/0165438 A1 Jun. 3, 2021

(51) Int. Cl.
*G05F 3/30* (2006.01)
*G05F 3/26* (2006.01)

(52) U.S. Cl.
CPC ..... *G05F 3/30* (2013.01); *G05F 3/267* (2013.01)

(58) Field of Classification Search
None
See application file for complete search history.

(56) References Cited

U.S. PATENT DOCUMENTS 8,022,686 B2 * 9/2011 Lu ..... G05F 3/30 323/315
8,368,377 B2 * 2/2013 Liu ..... G05F 3/30 323/314
10,684,637 B2 * 6/2020 Yoshida ..... G05F 1/465

FOREIGN PATENT DOCUMENTS

EP 0816965 A1 1/1998
WO 2009037532 A1 3/2009

OTHER PUBLICATIONS

"Line Voltage Rejection in a Bandgap Voltage Reference", IBM Technical Disclosure Bulletin, International Business Machines Corp. (Thornwood), US, vol. 30, No. 4, Sep. 1, 1987, 2 pages.
IT Search Report and Written Opinion for IT Appl. No. 102019000022518 dated Jul. 30, 2020 (13 pages).

* cited by examiner

*Primary Examiner* — Jeffery S Zweizig
(74) *Attorney, Agent, or Firm* — Crowe & Dunlevy

(57) ABSTRACT

A bandgap circuit includes a supply node as well as a first and second bipolar transistors having jointly coupled base terminal at a bandgap node providing a bandgap voltage. First and second current generators are coupled to the supply node and supply mirrored first and second currents, respectively, to first and second circuit nodes. A third circuit node is coupled to the first bipolar transistor via a first resistor and coupled to ground via a second resistor, respectively. The third circuit node is also coupled to the second bipolar transistor so that the second resistor is traversed by a current which is the sum of the currents through the bipolar transistors. A decoupling stage intermediate the current generators and the bipolar transistors includes first and second cascode decoupling transistors having jointly coupled control terminals receiving a bias voltage sensitive to the bandgap voltage.

20 Claims, 5 Drawing Sheets

BANDGAP REFERENCE CIRCUIT, CORRESPONDING DEVICE AND METHOD

PRIORITY CLAIM

This application claims the priority benefit of Italian Application for Patent No. 102019000022518, filed on Nov. 29, 2019, the content of which is hereby incorporated by reference in its entirety to the maximum extent allowable by law.

TECHNICAL FIELD

The description relates to bandgap reference circuits.

One or more embodiments may be applied, for instance, to display devices and other consumer/industrial electronics products.

BACKGROUND

Various practical applications in electronics may be faced with issues related a supply voltage which is not a steady-state value and can change, possibly with a very sharp profile.

For instance, active matrix organic light emitting diode (AMOLED) products may be exposed to time-division multiple-access (TDMA) noise and performance of such products may be tested with supply voltages variable with a slope in the order of 1V/10 μs.

In this kind of environment, power supply rejection (PSR) performance is a relevant factor, which in turn may depend on a bandgap reference voltage.

Achieving a stable, reliable bandgap reference voltage may thus represent a desirable goal to pursue in various applications.

There is a need in the art to overcome the drawbacks of conventional bandgap reference circuits.

SUMMARY

One or more embodiments may relate to a device. An AMOLED display device may be exemplary of such a device.

One or more embodiments may relate to a corresponding method.

One or more embodiments may be based on the recognition that an architecture comprising a NPN bipolar core is advantageous in comparison with a PNP-based architecture in achieving improved PSR performance.

In that respect, one or more embodiments may be based on the recognition that limited PSR performance may be related to the coupling between a supply voltage and the collector terminal of a bipolar transistor core. This may lead to a current mismatch of the core currents due to the loop reacting by changing the bandgap voltage $V_{BG}$ in order to equalize the core currents.

One or more embodiments may exhibit one or more of the following advantages: notable improvement in PSR performance, simple, single stage architecture (only four transistors added, for instance, to a conventional architecture), reduced impact on area and current consumption, and improved accuracy resulting from bipolar base current management.

In an embodiment, a circuit comprises: a supply voltage node; a bandgap voltage generator circuit including a first bipolar transistor and a second bipolar transistor, wherein the first and second bipolar transistors have base terminals jointly coupled to a bandgap node to provide a bandgap voltage; and a decoupling circuit configured to decouple the first and second bipolar transistors from the supply voltage node. The decoupling circuit comprises: a first decoupling transistor having a current flow path in series with the first bipolar transistor, wherein the first decoupling transistor is connected to a first circuit node intermediate between the first decoupling transistor and the supply voltage node; a second decoupling transistor having a current flow path in series with the second bipolar transistor, wherein the second decoupling transistor is connected to a second circuit node intermediate between the second decoupling transistor and the supply voltage node; and wherein control terminals of the first and second decoupling transistors jointly receive a voltage that is sensitive to the bandgap voltage at said bandgap node.

In an embodiment, a circuit comprises: a supply node; a first bipolar transistor and a second bipolar transistor, the first and second bipolar transistors having base terminals jointly coupled to a bandgap node to provide a bandgap voltage at the bandgap node; a first current generator coupled to the supply node and configured to supply a first current to a first circuit node; a second current generator coupled to the supply node and configured to supply a second current to a second circuit node, wherein the first and second current generators are mutually coupled so that the first current mirrors the second current; a third circuit node coupled to a current flow path through the first bipolar transistor via a first resistor and coupled to ground via a second resistor, respectively, wherein the third circuit node is coupled to a current flow path through the second bipolar transistor and the second resistor is traversed by a current which is the sum of currents in the current flow paths through the first bipolar transistor and the second bipolar transistor; a decoupling stage intermediate the first and second current generators and the first and second bipolar transistors. The decoupling stage comprises: a first decoupling transistor intermediate the first circuit node and the current flow path through the first bipolar transistor, wherein a current flow path through the first decoupling transistor provides a current transfer path from the first circuit node to the first bipolar transistor; a second decoupling transistor intermediate the second circuit node and the current flow path through the second bipolar transistor, wherein a current flow path through the second decoupling transistor provides a current transfer path from the second circuit node to the second bipolar transistor; and wherein the first decoupling transistor and the second decoupling transistor have control terminals jointly coupled to a fourth circuit node sensitive to the bandgap voltage at said bandgap node.

BRIEF DESCRIPTION OF THE DRAWINGS

One or more embodiments will now be described, by way of example only, with reference to the annexed figures, where like designation will be maintained for like parts or elements throughout the figures, and wherein.

DETAILED DESCRIPTION

In the following description, various specific details are given to provide a thorough understanding of various exemplary embodiments of the present specification. The embodiments may be practiced without one or several specific details, or with other methods, components, materials, etc. In other instances, well-known structures, materials, or operations are not shown or described in detail in order to avoid obscuring various aspects of the embodiments. Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings/references provided herein are for convenience only, and therefore do not interpret the extent of protection or scope of the embodiments.

Bandgap reference circuits are conventionally used to provide reference voltages and currents to a device, such as an entire chip, for instance.

Bandgap reference circuits can be regarded as auto-referred circuits, that is circuits which start operating automatically when a supply voltage is provided, with no reference currents and/or voltages involved in bandgap circuit design.

Figure 1:
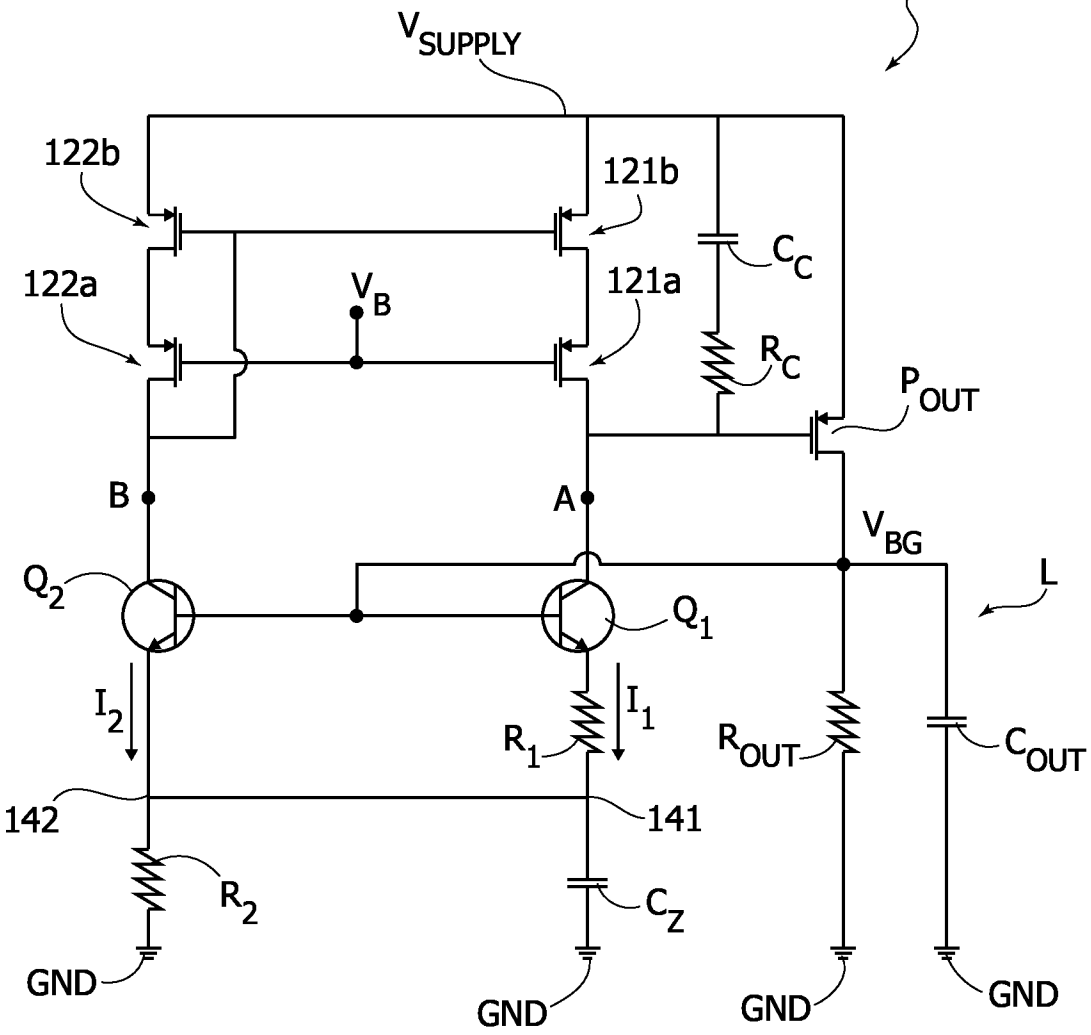
FIG. 1 (Prior Art)
FIGS. 1 and 2 are circuit diagrams exemplary of conventional bandgap reference arrangements.

A conventional architecture of a bandgap circuit 10 is represented in FIG. 1. The reference $V_{SUPPLY}$ denotes a supply node or line to be brought to a corresponding supply voltage in operation.

As represented in FIG. 1, the circuit 10 comprises two current flow paths from the supply node $V_{SUPPLY}$ to ground GND, each current flow path including the current flow path through a respective transistor $Q_1$ and $Q_2$.

As exemplified herein, the transistors $Q_1$ and $Q_2$ are bipolar transistors with the current flow path therethrough being the emitter-collector current flow path.

As exemplified herein, the transistors $Q_1$ and $Q_2$ are NPN transistors having their collectors oriented towards the supply node $V_{SUPPLY}$ and their emitters oriented towards ground GND.

References 121*a*, 121*b* and 122*a*, 122*b* denote two pairs of transistors (field-effect transistors such as mosfet transistors, for instance) coupled intermediate the supply node $V_{SUPPLY}$ and the transistors $Q_1$ and $Q_2$ (at points A and B corresponding to the collector terminals).

In more detail, the transistors 121*a* and 122*a* (those arranged nearer the transistors $Q_1$ and $Q_2$) have their control terminals (gates, in the case of field effect transistors such as mosfet transistors) mutually coupled. Furthermore, the transistors 121*b* and 122*b* (those arranged nearer the supply node $V_{SUPPLY}$) have their control terminals (gates, in the case of field effect transistors such as mosfet transistors) likewise mutually coupled, with the control terminal of the transistor 122*b* (which transistor is included in the current flow path from voltage $V_{SUPPLY}$ to ground GND passing through transistor $Q_2$) coupled to point B, that is to the collector of transistor $Q_2$.

Also, the control terminals (gates) of the transistors 121*a*, 122*a* are coupled to a bias node $V_B$ configured to receive a bias voltage (produced in a manner known to those of skill in the art).

The bandgap circuit 10 of FIG. 1 further includes a resistor $R_1$ coupled to the current flow path through transistor $Q_1$ (to the emitter) to be traversed by a current $I_1$ with a capacitor $C_Z$ intermediate resistor $R_1$ and ground GND. A node 141 intermediate the resistor $R_1$ and the capacitor $C_Z$ is coupled to the current flow path through transistor $Q_2$ (to the emitter) at a node 142 with a resistor $R_2$ intermediate the node 142 and ground GND. The reference $I_2$ denotes a current flowing from transistor $Q_2$ to the node 142. A compensation network comprising the series connection of capacitor $C_C$ and a resistor $R_C$ is coupled intermediate the supply node $V_{SUPPLY}$ and the node A intermediate the transistor pair 121*a*, 121*b* and the transistor $Q_1$. A transistor $P_{OUT}$ (a field-effect transistor such as a mosfet transistor) is coupled with its control terminal (gate in the case of a field-effect transistor such as a mosfet transistor) to the node A and the current flow path therethrough (source-drain in the case of a field-effect transistor such as a mosfet transistor) intermediate the supply node $V_{SUPPLY}$ and a node $V_{BG}$ which is in turn coupled to the mutually-coupled control terminals (bases in the case of a bipolar transistors) of transistors $Q_1$ and $Q_2$.

The transistors 121*a*, 121*b* and 122*a*, 122*b* thus provide a current mirror arrangement supplying currents $I_1$, $I_2$ having essentially the same intensity towards the nodes A and B, that is towards the transistors $Q_1$ and $Q_2$.

The node $V_{BG}$ can be regarded as exemplary of an output node of the circuit 10 where a homologous bandgap voltage $V_{BG}$ can be made available to a load L (as available inside an AMOLED display unit, for instance). The load L is here exemplified as a parallel connection, referred to ground GND, of a resistive load component $R_{OUT}$ and a capacitive load component $C_{OUT}$.

It will be appreciated that the load L may be a distinct element from the circuit 10 (and, as such, a distinct element from the embodiments).

In a manner known to those of skill in the art, operation of a bandgap circuit as exemplified in FIG. 1 is based on the provision of two bipolar transistors $Q_1$, $Q_2$ having different junction areas, for instance the junction area for transistor $Q_1$ being n times the junction area for transistor $Q_2$ so that the base-emitter voltage $V_{BE1}$ for transistor $Q_1$ will be correspondingly smaller than the base-emitter voltage $V_{BE2}$ for transistor $Q_2$, that is $V_{BE2}=V_{BE1}$ 60 mV, for instance (such a figure is merely by way of example and non-limiting).

A bandgap circuit as exemplified in FIG. 1 relies on the possibility of generating a bandgap voltage $V_{BG}$ based on a relationship of the type:

$$V_{BG}=V_{BE}+k\Delta V_{BE}$$

where: $\Delta V_{BE}$ can be expressed as the difference between the base-emitter voltages of two transistors, $\Delta V_{BE}=V_{BE2}-V_{BE1}$. The voltage $V_{BE}$ may exhibit a variation (a decrease) with temperature of about 2 mV/° C., while the voltage $\Delta V_{BE}$ may exhibit an—opposite—variation (that is an increase) with temperature of about 0.2 mV/° C.

By adequately selecting k (k=10, for instance) the two variations for $V_{BE}$ and $k\Delta V_{BE}$ (having opposite signs) may mutually compensate—at least approximately—so that $V_{BG}$ is stable with temperature.

In a bandgap circuit as exemplified in FIG. 1:

$$V_{BE2}=V_{BE1}+I_1*R_1, \text{ and}$$

$$=(V_{BE2}-V_{BE1})/R_1=\Delta V_{BE}/R_1.$$

In a bandgap circuit as exemplified in FIG. 1 the current mirror arrangement with transistors 121*a*, 121*b* and 122*a*, 122*b* causes currents $I_1$ and $I_2$ to have the same intensities so that the current through resistor $R_2$ (with no DC current flowing through capacitor $C_Z$) will be equal to $2I_1$ and the voltage drop $V_{R2}$ across resistor $R_2$ will be:

$$V_{R2}=R_2*2I_1=R_2*2\Delta V_{BE}/R_1=2(R_2/R_1)*\Delta V_{BE}.$$

The voltage (namely $V_{BG}$) present at the mutually coupled bases of transistors $Q_1$ and $Q_2$ can thus be expressed as:

$$V_{BG}=V_{R2}+V_{BE2}=V_{BE2}+2(R_2/R_1)*\Delta V_{BE},$$

where $2(R_2/R_1)$ is exemplary of a value for k (k=10, for instance) which may facilitate bandgap temperature compensation as discussed previously.

In a bandgap circuit as exemplified in FIG. 1, the coupling from $V_{SUPPLY}$ to node A and node B is different, resulting in a differential signal on the collector terminals of the bipolar transistors $Q_1$ and $Q_2$. This differential signal results in a variation of the core currents $I_1$ and $I_2$: indeed, the loop intrinsic in the circuit "reads" this current difference and reacts by changing the voltage $V_{BG}$ in order to compensate the initial current difference (negative feedback).

Such a change in voltage $V_{BG}$ (as discussed, $V_{BG}$ is essentially the output from the bandgap circuit 10) represents a limit placed on power supply rejection (PSR) performance and can be regarded as a basic drawback of conventional bandgap architectures.

It is noted that such an issue can be addressed with the aim of achieving a higher PSR by resorting to a two-step (two-stage) bandgap reference circuit.

Figure 2:
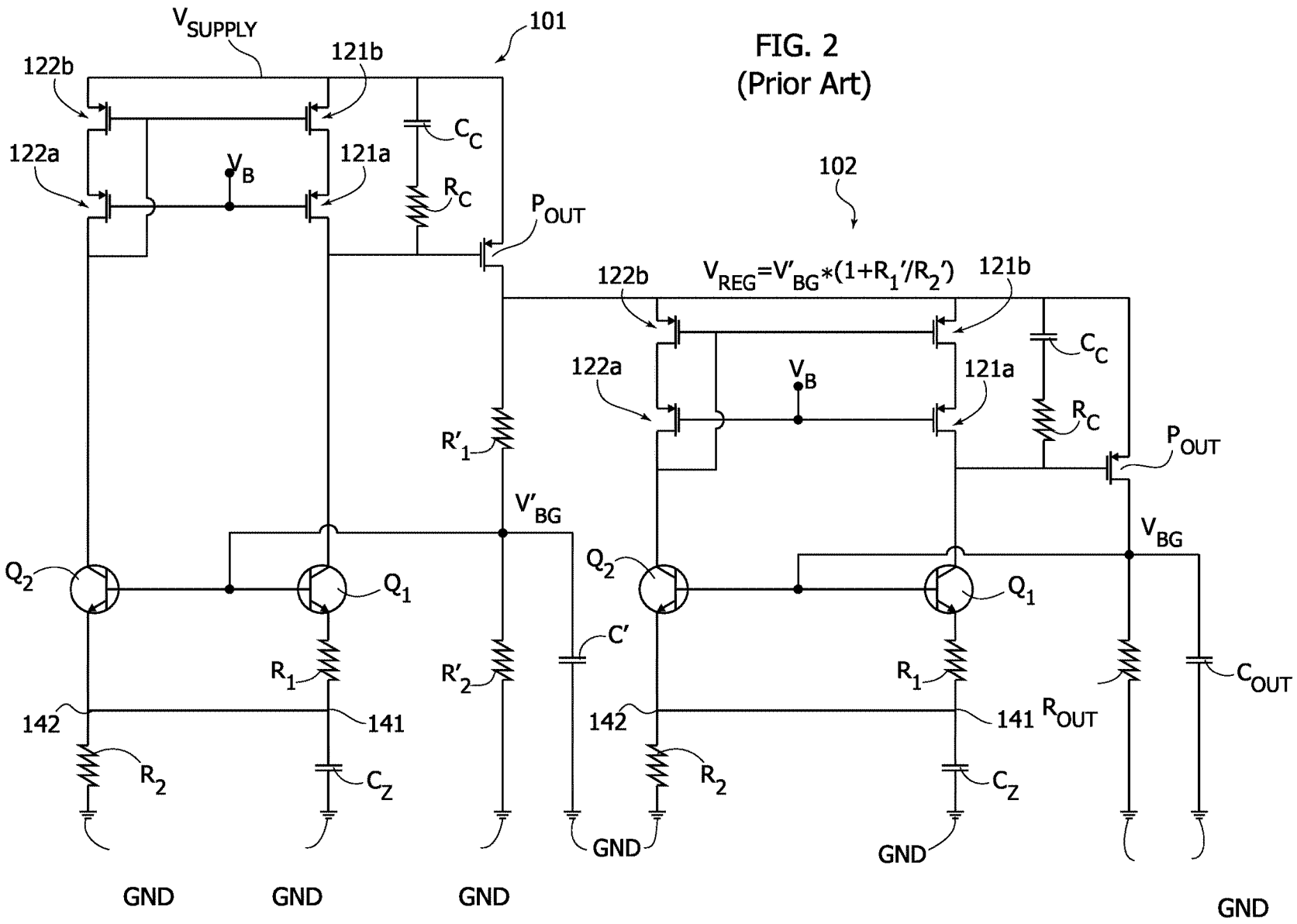
FIG. 2 (Prior Art)

For instance, FIG. 2 is illustrative of a solution comprising a pre-regulator (auto-referenced) stage 101 that provides a supply voltage $V'_{BG}$ for a bandgap circuit 102.

As exemplified in FIG. 2, each of the two stages 101, 102 may essentially reproduce the architecture of FIG. 1: for that reason, like reference symbols are used in both stages 101, 102 to indicate parts or elements like part or elements already discussed in connection with FIG. 1.

Briefly, in an arrangement as exemplified in FIG. 2, the bandgap circuit 102 acts as a sort of load to the pre-regulator stage 101, which supplies the bandgap circuit 102 with a (regulated) supply voltage $V_{REG}=V'_{BG}*(1+R_1'/R_2')$.

That voltage can be obtained at the transistor $P_{OUT}$ (of the pre-regulator stage 101) which is coupled to ground GND via a voltage divider comprising two resistors $R_1'$ (upper branch) and $R_2'$ (lower branch) with a capacitor C' in parallel to resistor $R_2'$ and the intermediate point between resistors $R_1'$ and $R_2'$ coupled to the mutually-coupled bases of transistors $Q_1$ and $Q_2$.

It can be demonstrated that the final PSR (at the output $V_{BG}$ the bandgap circuit 102) of an arrangement as exemplified in FIG. 2 is the sum (in decibel) of the individual PSRs of the pre-regulator 101 and the bandgap circuit 102.

An arrangement as exemplified in FIG. 2 may exhibit substantial drawbacks in terms of semiconductor area occupied and current consumption.

Figure 3:
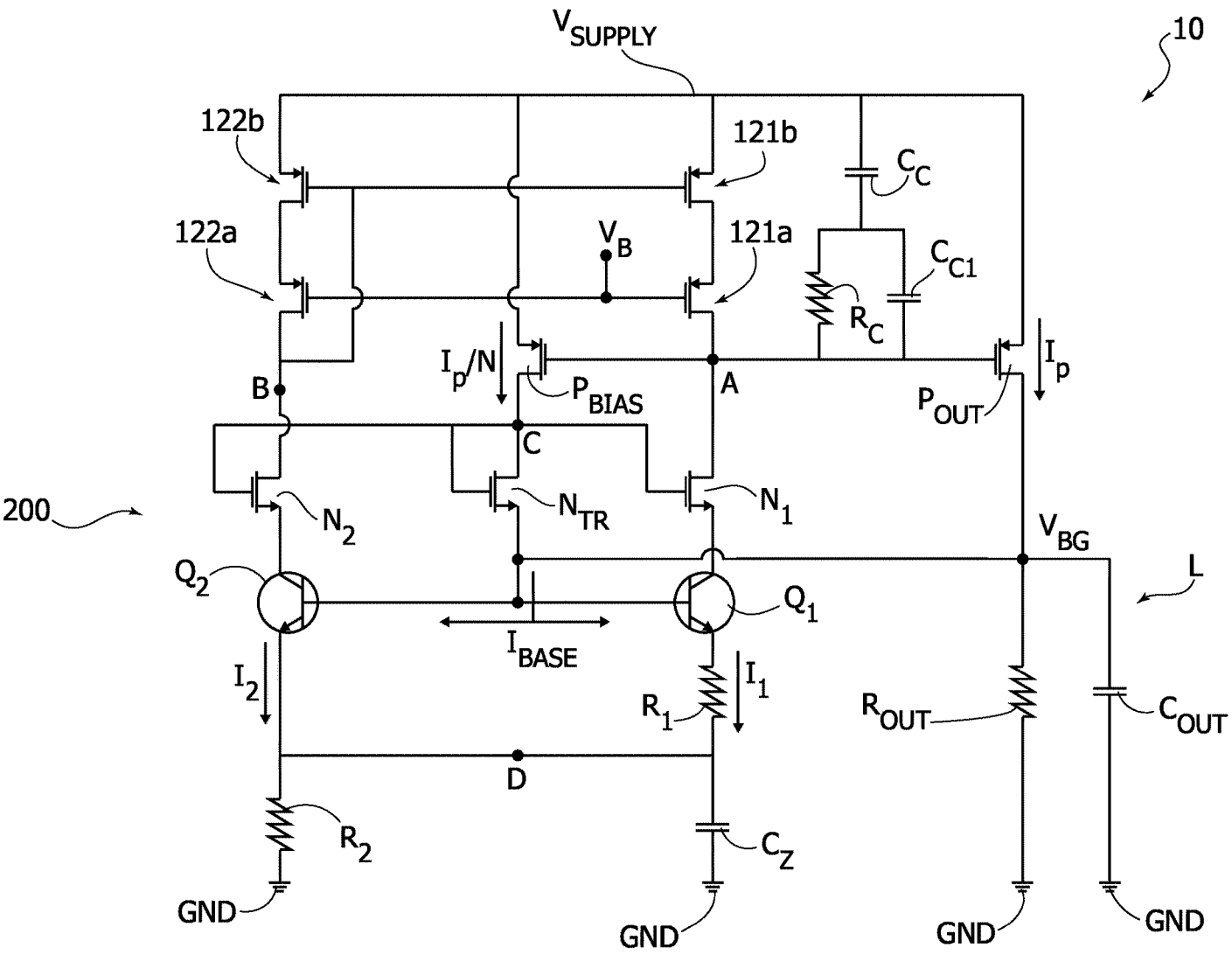
FIG. 3 is a circuit diagram of a bandgap reference arrangement according to embodiments as exemplified herein.
Figure 4:
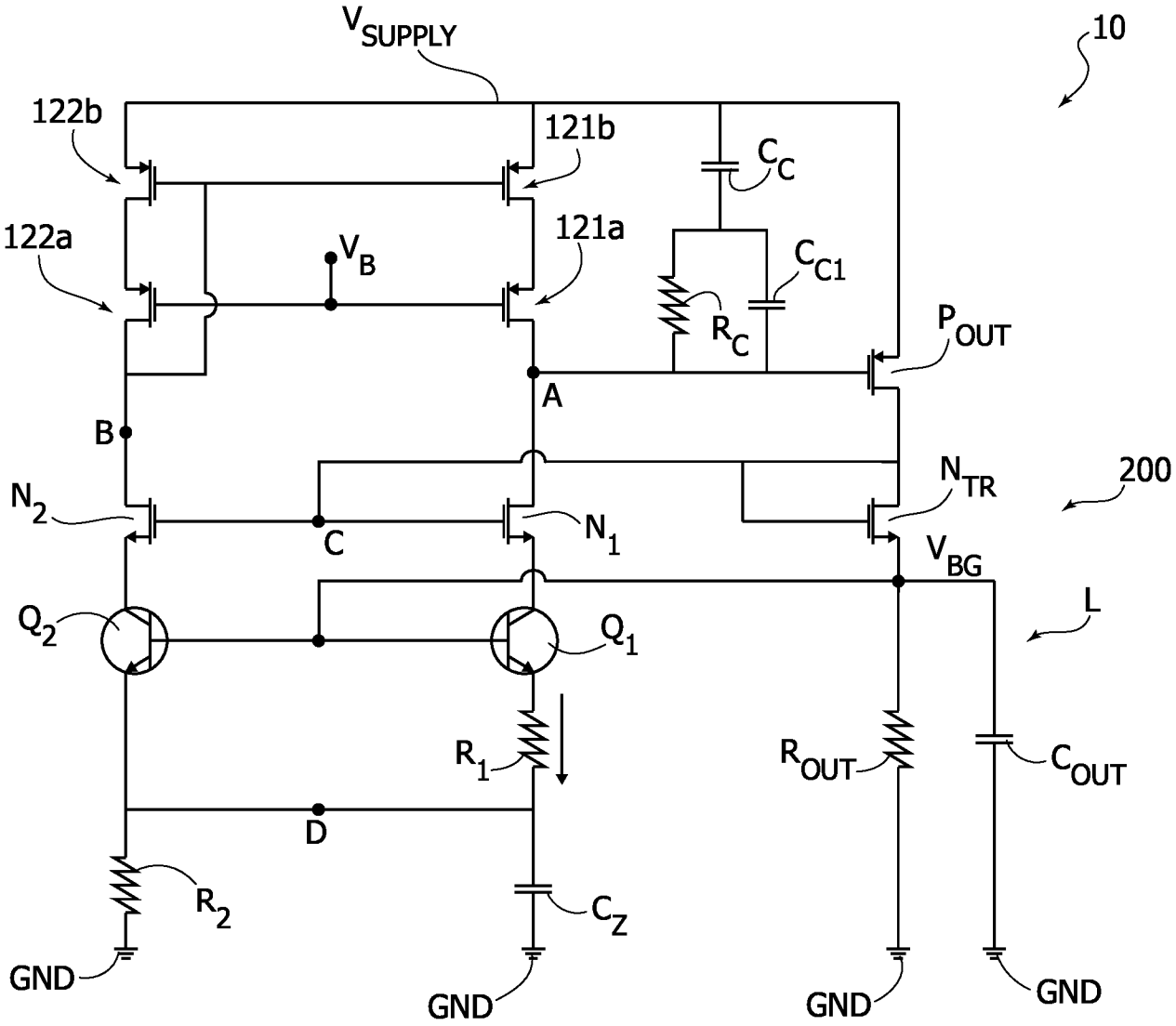
FIG. 4 is a circuit diagram of a bandgap reference arrangement according to embodiments as exemplified herein.

In one or more embodiments as exemplified in FIGS. 3 and 4, circuit performance is improved by decoupling the (collector voltages of the) "core" bipolar transistors $Q_1$ and $Q_2$ from the $V_{SUPPLY}$ node with the framework of a single-stage architecture.

In FIGS. 3 and 4, parts or elements like parts or elements already discussed in connection with FIGS. 1 and 2 are indicated with like reference symbols; consequently a detailed description of these parts or elements will not be repeated for brevity. For the same reason, the nodes 141, 142 of FIGS. 1 and 2 as well as any connection line between them will be briefly referred to as a node D.

The one or more embodiments as exemplified in FIGS. 3 and 4 take into account the fact that no reference voltage is generally available for bandgap circuit design (in an arrangement as exemplified in FIG. 2 such a limitation is attempted to be overcome by using a double stage architecture, with drawbacks in terms of area and current consumption as discussed).

In one or more embodiments as exemplified in FIGS. 3 and 4, a decoupling stage 200 is provided intermediate the transistor (mosfet) pairs 121*a*, 121*b* and 122*a*, 122*b* and the bipolar transistors $Q_1$ and $Q_2$.

In one or more embodiments as exemplified in FIG. 3 the decoupling stage 200 may comprise a cascode arrangement of two transistors $N_1$, $N_2$ (NMOS transistors for instance) with their control terminals (gates, in the case of field effect transistors such as mosfet transistors) jointly connected to a ground-referred voltage reference provided at a point C as discussed in the following.

Stated otherwise, one or more embodiments may provide a single stage bandgap circuit architecture, where a bandgap-referred reference voltage is used to bias the gates of NMOS transistors $N_1$, $N_2$ in order to decouple the (collector terminals of) bipolar core transistor $Q_1$, $Q_2$ from the node $V_{SUPPLY}$.

One or more embodiments may thus rely on the fact that the bandgap voltage $V_{BG}$ is an advantageous ground-referred voltage available in bandgap circuits, and may provide a circuit architecture which is also able to manage the base current of transistors $Q_1$ and $Q_2$ thus improving $V_{BG}$ accuracy.

In one or more embodiments, the NMOS cascode transistors $N_1$ and $N_2$ arranged between the nodes A, B and the collector terminals of the bipolar transistors $Q_1$ and $Q_2$ may be beneficial in reducing the risk that a voltage difference between the nodes A and B may result in an undesired variation of the currents in transistors $Q_1$ and $Q_2$.

In one or more embodiments, operation of transistors $N_1$ and $N_2$ as cascodes is facilitated by their gates being biased with a ground-referred voltage. Thus, one or more embodiments effectively address the issue of finding a satisfactory ground-referred voltage in a circuit (such as the circuit 10 considered herein) whose only input is represented by the supply voltage at $V_{SUPPLY}$.

One or more embodiments may rely on the recognition that the bandgap voltage $V_{BG}$ output from the bandgap circuit 10 is by itself a ground-referred voltage so that the control electrodes of the cascode transistors N1, N2 can be biased with a voltage referred to the bandgap voltage $V_{BG}$ since $V_{BG}$ is itself a ground-referred voltage.

In one or more embodiments as exemplified in FIG. 3, the control terminals (gates, in the case of field effect transistors such as mosfet transistors) of the cascode transistors $N_1$ and $N_2$ are driven by the bandgap voltage $V_{BG}$ through a diode-connected transistor $N_{TR}$.

In the illustrative embodiment considered herein, transistor $N_{TR}$ is an NMOS transistor having its gate shorted to the drain at node C to which the control terminals of the cascode transistors $N_1$ and $N_2$ are coupled.

In one or more embodiments, a bias transistor (such as a PMOS transistor) $P_{BIAS}$ is arranged with the current flow path therethrough (the source-drain path in the case of a field-effect transistor such as PMOS transistor) to apply to the node C (and thus to $N_{TR}$) a bias current $I_P/N$, that is N-factor scaled-down copy of the current $I_P$ through the output transistor $P_{OUT}$, which is mirrored onto transistor $P_{BIAS}$ via the node A.

In one or more embodiments, the compensation network with capacitor $C_C$ and resistor $R_C$ (possibly supplemented with a further capacitor $C_{C1}$ in parallel to $R_C$) between the node $V_{SUPPLY}$ and the node A facilitates a good coupling between $V_{SUPPLY}$ and the gate of transistor $P_{OUT}$ and transistor $P_{BIAS}$. This in turn facilitates rendering the currents $I_P$ and $I_P/N$ (almost) independent of supply voltage variations, which further contributes in making the voltage at node C a good ground-referred voltage.

Another advantage related to the provisions of transistor $N_{TR}$ lies in that transistor $N_{TR}$ can source the base currents of transistors $Q_1$ and $Q_2$, which may further improve the final accuracy of the bandgap voltage $V_{BG}$.

FIG. 4 is illustrative of embodiments wherein the transistor $P_{BIAS}$ current branch of FIG. 3 is dispensed with, by arranging transistor $N_{TR}$ in the output path intermediate transistor $P_{OUT}$ and the voltage $V_{BG}$.

Here again, the control terminals (gates, in the case of field effect transistors such as mosfet transistors) of the cascode transistors $N_1$-$N_2$ are driven by the bandgap voltage $V_{BG}$ through the diode-connected transistor $N_{TR}$. Here again, transistor $N_{TR}$ is an NMOS transistor having its gate shorted to the drain at node C to which the control terminals of the cascode transistors $N_1$ and $N_2$ are coupled.

As noted, in the case of embodiments as exemplified in FIG. 4, transistor $N_{TR}$ is arranged in the output path intermediate transistor $P_{OUT}$ and voltage $V_{BG}$ with the current flow path therethrough (source-drain in the case of a field-effect transistor such as an NMOS transistor) coupled between voltage $V_{BG}$ and the current flow path through transistor $P_{our}$.

It is observed that embodiments as exemplified in FIGS. 3 and 4 provide comparable performance in terms of PSR.

In comparison with conventional bandgap circuit architectures as exemplified in FIG. 1, embodiments as exemplified in FIGS. 3 and 4 may provide a significant improvement in terms of PSR (power supply rejection), with values as high as approximately 40 dB below 1 kHz and more than 20 dB above 1 kHz.

In comparison with two-stage bandgap arrangements as exemplified in FIG. 2, embodiments as exemplified in FIGS. 3 and 4 may provide similar results in terms of PSR performance at low-medium frequencies, with a notable improvement above 10 kHz.

As regards response to TDMA noise stimulus (supply voltage variation with rising and falling slope of 1V/10 μs) embodiments as exemplified in FIGS. 3 and 4 can provide appreciably improved results in comparison with both conventional bandgap circuit architectures as exemplified in FIG. 1 and two-stage bandgap arrangements as exemplified in FIG. 2.

Peak-to-peak bandgap variation can be about 1 mV during $V_{SUPPLY}$ transient in embodiments as exemplified herein in comparison 8 mV (standard bandgap circuit architecture of FIG. 1) and 5 mV (two-stage bandgap arrangement of FIG. 2).

Figure 5:
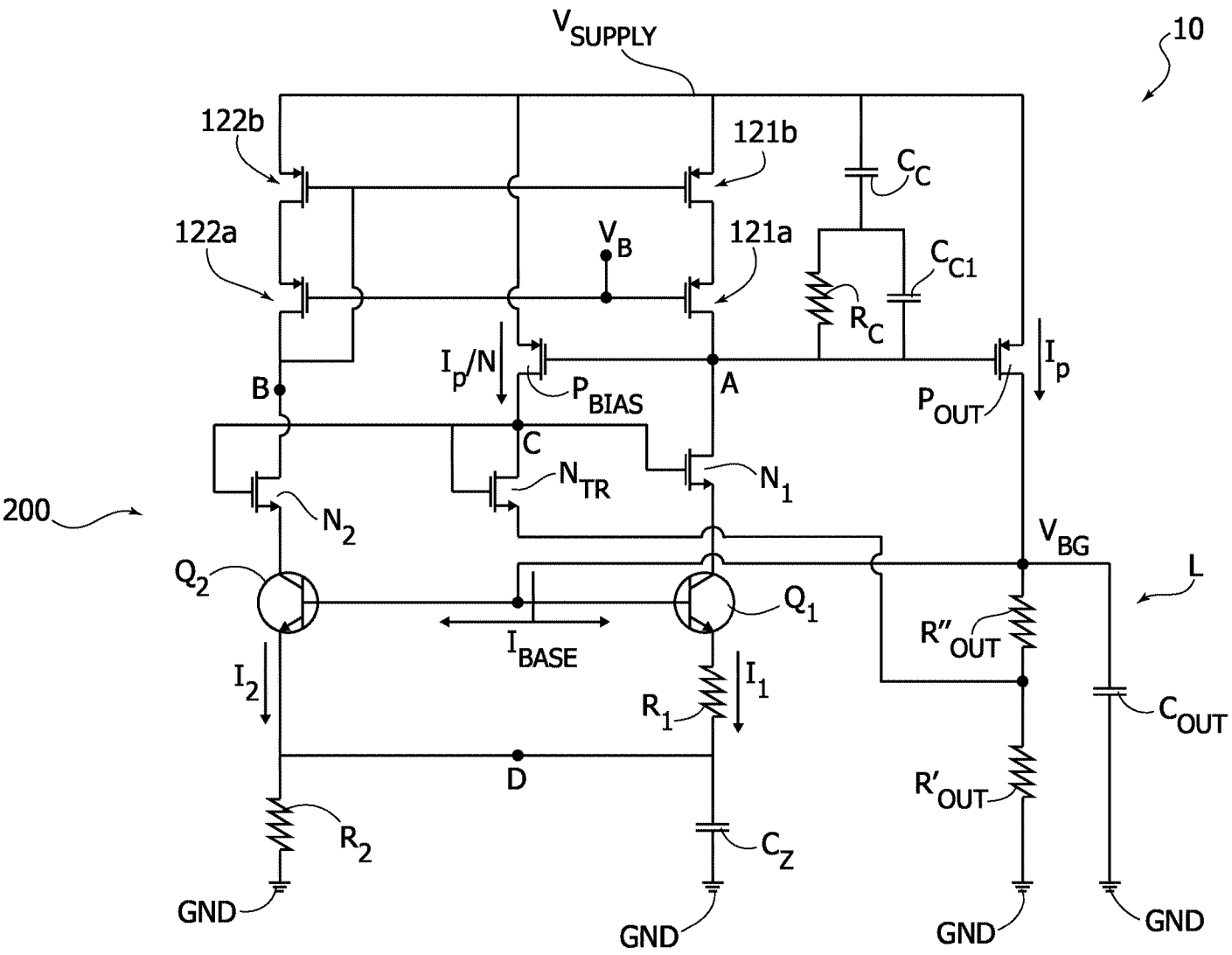
FIG. 5 is a circuit diagram of a bandgap reference arrangement according to embodiments as exemplified herein.

Reference is now made to FIG. 5 showing a modification of the circuit shown in FIG. 3. FIG. 5 differs from FIG. 3 in terms of where the source terminal of the diode-connected transistor $N_{TR}$ is referenced. In FIG. 3, the source terminal of the diode-connected transistor $N_{TR}$ is connected to the voltage $V_{BG}$. In the FIG. 5 implementation, the resistor $R_{OUT}$ is split into a voltage divider circuit formed by the series connection of resistor $R''_{OUT}$ and resistor $R'_{OUT}$. The intermediate (tap) node at the connection of resistors $R''_{OUT}$ and $R'_{OUT}$ is connected to the source terminal of the diode-connected transistor $N_{TR}$. Thus, instead of being referenced to the voltage $V_{BG}$, the diode-connected transistor $N_{TR}$ is referenced to a voltage which is a fraction of the voltage $V_{BG}$ set by the voltage divider circuit. The advantage of this FIG. 5 circuit over the FIG. 3 circuit is support of operation in situations where the supply voltage $V_{SUPPLY}$ is reduced.

A circuit (for instance, 10) as exemplified herein may comprise: a supply node (for instance, $V_{SUPPLY}$), a first bipolar transistor (for instance, $Q_1$) and a second bipolar transistor (for instance, $Q_2$), the first and second bipolar transistors having base terminals jointly coupled to a bandgap node to provide a bandgap voltage (for instance, $V_{BG}$) at the bandgap node, a first current generator (for instance, 121*a*, 121*b*) coupled to the supply node, the first current generator configured to supply a first current (for instance, $I_1$) to a first circuit node (for instance, A), a second current generator (for instance, 122*a*, 122*b*) coupled to the supply node, the second current generator configured to supply a second current (for instance, $I_2$) to a second circuit node (for instance, B), the first and second current generators mutually coupled (in a current-mirror arrangement, for instance) wherein the first current of the first current generator mirrors the second current of the second current generator, a third circuit node (for instance, D—see also 141 and 142 in FIGS. 1 and 2) coupled to the current flow path (emitter-collector) through the first bipolar transistor via a first resistor (for instance, $R_1$) and coupled to ground via a second resistor (for instance, $R_2$), respectively, wherein the third circuit node is coupled to the current flow path (emitter-collector) through the second bipolar transistor and the second resistor is traversed by a current which is the sum of the currents in the current flow paths through the first bipolar transistor and the second bipolar transistor, and a decoupling stage (for instance, 200) intermediate the first and second current generators and the first and second bipolar transistors.

The decoupling stage may comprise: a first (cascode) decoupling transistor (for instance, $N_1$) intermediate the first circuit node and the current flow path through the first bipolar transistor (for instance, $Q_1$), wherein the current flow path through the first decoupling transistor (source-drain, in the exemplary case of a field-effect transistor such as a mosfet transistor) provides a current transfer path from the first circuit node to the first bipolar transistor, a second (cascode) decoupling transistor (for instance, $N_2$) intermediate the second circuit node and the current flow path through the second bipolar transistor, wherein the current flow path through the second decoupling transistor (source-drain, in the exemplary case of a field-effect transistor such as a mosfet transistor) provides a current transfer path from the second circuit node to the second bipolar transistor, and wherein the first decoupling transistor and the second decoupling transistor have control terminals (gates, in the exemplary case of field-effect transistors such as mosfet transistors) jointly coupled to a fourth circuit node (for instance, C) sensitive to the bandgap voltage at said bandgap node.

A circuit as exemplified herein may comprise an output transistor (for instance, $P_{OUT}$) having a current flow path therethrough (source-drain, in the exemplary case of a field-effect transistor such as a mosfet transistor) intermediate said supply node and said bandgap node and a control terminal (gate, in the exemplary case of a field-effect transistor such as a mosfet transistor) coupled to said first circuit node, with, optionally, an RC compensation network (for instance, $C_C$, $R_C$, $C_{C1}$) coupled between said supply node and said first circuit node.

A circuit as exemplified herein may comprise a diode-connected transistor (for instance, $N_{TR}$) intermediate said fourth circuit node and said bandgap node.

A circuit as exemplified herein may comprise bias generation circuitry for said diode-connected transistor, wherein the bias generation circuitry comprises a bias transistor (for instance, $P_{BIAS}$) arranged with the current flow path therethrough (source-drain, in the exemplary case of a field-effect transistor such as a mosfet transistor) between said supply node and said fourth circuit node (C).

In a circuit as exemplified herein, said bias transistor may be coupled to said output transistor ($P_{OUT}$) in a current mirror arrangement to supply to said fourth circuit node a bias current which is a N-factor scaled-down replica of a current (for instance, $I_P$) in the current flow path through said output transistor.

In a circuit as exemplified herein said diode-connected transistor intermediate said fourth circuit node and said bandgap node may be arranged with the current flow path therethrough in series with the current flow path through said output transistor.

In a circuit as exemplified herein said first decoupling transistor and said second decoupling transistor may comprise field-effect transistors, preferably NMOS transistor.

In a circuit as exemplified herein said first bipolar transistor may have a base-emitter voltage (for instance, $V_{BE1}$) which is smaller, and optionally about 60 mV less, than the base-emitter voltage (for instance, $V_{BE2}$) of said second bipolar transistor.

In a circuit as exemplified herein, said first bipolar transistor and said second bipolar transistor may comprise NPN bipolar transistors.

A device (for instance, 10, L—an AMOLED display device may exemplary of such a device) as exemplified herein may comprise: a circuit (for instance, 10) as exemplified herein, and an electrical load (for instance, L) coupled to said bandgap node to receive therefrom said bandgap voltage (for instance, $V_{BG}$).

Exemplified herein is also a method of countering temperature-dependent variations of bandgap voltage produced via a circuit (for instance, 10) comprising: a supply node, a first bipolar transistor and a second bipolar transistor, the first and second bipolar transistors having base terminals jointly coupled to a bandgap node to provide a bandgap voltage at the bandgap node, a first current generator coupled to the supply node, the first current generator configured to supply a first current to a first circuit node, a second current generator coupled to the supply node, the second current generator configured to supply a second current to a second circuit node, the first and second current generators mutually coupled wherein the first current of the first current generator mirrors the second current of the second current generator, a third circuit node coupled to the current flow path through the first bipolar transistor via a first resistor and coupled to ground via a second resistor, respectively, wherein the third circuit node is coupled to the current flow path through the second bipolar transistor and the second resistor is traversed by a current which is the sum of the currents in the current flow paths through the first bipolar transistor and the second bipolar transistor.

A method as exemplified may comprise providing, intermediate the first and second current generators and the first and second bipolar transistors, a decoupling stage which may comprise: a first decoupling transistor intermediate the first circuit node and the current flow path through the first bipolar transistor, wherein the current flow path through the first decoupling transistor provides a current transfer path from the first circuit node to the first bipolar transistor, a second decoupling transistor intermediate the second circuit node and the current flow path through the second bipolar transistor, wherein the current flow path through the second decoupling transistor provides a current transfer path from the second circuit node to the second bipolar transistor, and wherein the first decoupling transistor and the second decoupling transistor have control terminals jointly coupled to a fourth circuit node sensitive to the bandgap voltage at said bandgap node.

The details and embodiments may vary with respect to what has been disclosed herein and merely by way of example without departing from the extent of protection.

The claims are an integral part of the technical disclosure of embodiments as provided herein.

The extent of protection is determined by the annexed claims.

The invention claimed is:

1. A circuit, comprising:

a supply voltage node;

a bandgap voltage generator circuit including a first bipolar transistor and a second bipolar transistor, wherein the first and second bipolar transistors have base terminals jointly coupled to a bandgap node to provide a bandgap voltage; and a decoupling circuit configured to decouple the first and second bipolar transistors from the supply voltage node, the decoupling circuit comprising:

a first decoupling transistor having a current flow path in series with the first bipolar transistor, wherein the first decoupling transistor is connected to a first circuit node intermediate between the first decoupling transistor and the supply voltage node;

a second decoupling transistor having a current flow path in series with the second bipolar transistor, wherein the second decoupling transistor is connected to a second circuit node intermediate between the second decoupling transistor and the supply voltage node; and a diode-connected transistor having a first terminal coupled to the control terminals of the first and second decoupling transistors and a second terminal coupled to the bandgap node.

2. The circuit of claim 1, wherein the first terminal of the diode-connected transistor is directly connected to the control terminals of the first and second decoupling transistors and wherein the second terminal of the diode-connected transistor is directly connected to the bandgap node.

3. The circuit of claim 2, further comprising an output transistor having a current flow path between the supply voltage node and the bandgap node, wherein a control terminal of the output transistor is connected to the first circuit node.

4. The circuit of claim 2, further comprising a biasing transistor having a current flow path between the supply voltage node and the first terminal of the diode-connected transistor, wherein a control terminal of the biasing transistor is connected to the first circuit node.

5. The circuit of claim 4, further comprising an output transistor having a current flow path between the supply voltage node and the bandgap node, wherein a control terminal of the output transistor is connected to the first circuit node.

6. The circuit of claim 2, further comprising an output transistor having a current flow path between the supply voltage node and the first terminal of the diode-connected transistor, wherein a control terminal of the output transistor is connected to the first circuit node.

7. The circuit of claim 1, wherein the first terminal of the diode-connected transistor is directly connected to the control terminals of the first and second decoupling transistors and wherein the second terminal of the diode-connected transistor is coupled to the bandgap node through a voltage divider circuit coupled between the bandgap node and a reference node.

8. The circuit of claim 7, further comprising an output transistor having a current flow path between the supply voltage node and the bandgap node, wherein a control terminal of the output transistor is connected to the first circuit node.

9. The circuit of claim 8, further comprising a biasing transistor having a current flow path between the supply voltage node and the first terminal of the diode-connected transistor, wherein a control terminal of the biasing transistor is connected to the first circuit node.

10. The circuit of claim 9, further comprising an output transistor having a current flow path between the supply voltage node and the bandgap node, wherein a control terminal of the output transistor is connected to the first circuit node.

11. The circuit of claim 1, wherein the decoupling circuit further comprises a biasing transistor having a current flow path between the supply voltage node and the control terminals of the first and second decoupling transistors, said biasing transistor having a control terminal coupled to the first circuit node.

12. The circuit of claim 1, further comprising an output transistor having a current flow path between the supply voltage node and the bandgap node, said output transistor having a control terminal coupled to the first circuit node.

13. The circuit of claim 1, wherein the bandgap voltage generator circuit further comprises:

a first current generator coupled to the supply voltage node and configured to supply a first current to the first circuit node;

a second current generator coupled to the supply voltage node and configured to supply a second current to the second circuit node;

wherein the first and second currents are mirror currents.

14. The circuit of claim 1, further comprising a load connected to receive the bandgap voltage at said bandgap node.

15. The circuit of claim 1, wherein the bandgap voltage generator circuit comprises a third circuit node coupled to a current flow path through the first bipolar transistor via a first resistor and coupled to ground via a second resistor, respectively, wherein the third circuit node is coupled to a current flow path through the second bipolar transistor and the second resistor is traversed by a current which is the sum of currents in the current flow paths through the first bipolar transistor and the second bipolar transistor.

16. The circuit of claim 15, further comprising:

a first compensation capacitor coupled between the supply voltage node and the first circuit node; and a second compensation capacitor coupled in parallel with the second resistor.

17. The circuit of claim 1, further comprising an RC compensation network coupled between said supply voltage node and said first circuit node.

18. The circuit of claim 1, wherein said first decoupling transistor and said second decoupling transistor comprise field-effect transistors.

19. The circuit of claim 1, wherein said first bipolar transistor has a base-emitter voltage smaller than a base-emitter voltage of said second bipolar transistor.

20. The circuit of claim 1, wherein said first bipolar transistor and said second bipolar transistor comprise NPN bipolar transistors.

* * * * *